US009382884B2

(12) United States Patent
Schmieder et al.

(10) Patent No.: US 9,382,884 B2
(45) Date of Patent: Jul. 5, 2016

(54) VALVE FOR METERING FLUID

(71) Applicants: Dietmar Schmieder, Markgroeningen (DE); Tilo Landenfeld, Vaihingen/Enz (DE)

(72) Inventors: Dietmar Schmieder, Markgroeningen (DE); Tilo Landenfeld, Vaihingen/Enz (DE)

(73) Assignee: ROBERT BOSCH GMBH, Stuttgart (DE)

( * ) Notice: Subject to any disclaimer, the term of this patent is extended or adjusted under 35 U.S.C. 154(b) by 163 days.

(21) Appl. No.: 14/246,450

(22) Filed: Apr. 7, 2014

(65) Prior Publication Data

US 2014/0306034 A1 Oct. 16, 2014

(30) Foreign Application Priority Data

Apr. 11, 2013 (DE) ..... 10 2013 206 417

(51) Int. Cl.
*F02M 51/06* (2006.01)
*F02M 61/20* (2006.01)
*F02M 61/08* (2006.01)

(52) U.S. Cl.
CPC ..... *F02M 51/0625* (2013.01); *F02M 51/061* (2013.01); *F02M 51/0607* (2013.01); *F02M 51/0678* (2013.01); *F02M 61/08* (2013.01); *F02M 61/20* (2013.01); *F02M 2200/50* (2013.01)

(58) Field of Classification Search
CPC ..... F02M 51/061; F02M 51/0603; F02M 51/0607; F02M 51/0625; F02M 61/20
See application file for complete search history.

(56) References Cited

U.S. PATENT DOCUMENTS

| | | | | |
|---|---|---|---|---|
| 2,808,293 | A | 10/1957 | Schenk | |
| 5,044,563 | A * | 9/1991 | Mesenich | F02M 51/005 239/585.4 |
| 5,069,189 | A * | 12/1991 | Saito | F02M 51/0653 123/533 |
| 6,148,842 | A * | 11/2000 | Kappel | F02M 61/167 137/78.1 |
| 6,722,579 | B1 * | 4/2004 | Boecking | F02M 47/027 239/124 |
| 2001/0032612 | A1 * | 10/2001 | Welch | F02M 21/0254 123/294 |

FOREIGN PATENT DOCUMENTS

| | | |
|---|---|---|
| DE | 933003 | 9/1955 |
| DE | 102004027637 | 1/2006 |
| DE | 102004045393 | 3/2006 |
| EP | 2 366 888 | 9/2011 |
| FR | 2056461 | 5/1971 |
| WO | WO 02/46604 | 6/2002 |

* cited by examiner

*Primary Examiner* — Ryan Reis
(74) *Attorney, Agent, or Firm* — Norton Rose Fulbright US LLP

(57) ABSTRACT

A valve for metering fluid under pressure includes: a valve housing which has an inlet opening and a metering opening as well as a valve seat enclosing the metering opening having an outwardly pointing seat surface; a valve needle carrying a closing head; a valve-closing spring acting on the valve needle and applying the closing head to the valve seat; and an electrical actuator, which applies a compressive force to the valve needle, lifting the closing head outwardly away from the valve seat. To prevent transverse forces on the valve needle, which can cause a deflection of the valve needle, a gimbal-mounted spring disk, which is pushed onto the valve needle, is used as the valve-closing spring.

16 Claims, 5 Drawing Sheets

VALVE FOR METERING FLUID

BACKGROUND OF THE INVENTION

1. Field of the Invention

The present invention relates to a valve for metering fluid, the umbrella term "fluid" referring to a flowing medium, for both gases and liquids in accordance with fluid dynamics.

2. Description of the Related Art

In a known, so-called outward-opening injector (Published European patent application document EP 2 366 888 A1), the valve housing has a hollow cylindrical nozzle body including a valve seat surrounding the nozzle opening situated at one end, a housing pot having the nozzle body protruding centrally through its pot bottom into the housing pot, and a housing cap which seals the housing pot and has a cap jacket and cap bottom, an inlet connection for the fluid being situated in the cap jacket. Inside the housing pot, a solenoid coil of an electromagnet sits on the nozzle body. A ring plate made of a nonmagnetic material is connected to the magnet pot and the nozzle body in a fluid-tight manner in each case and, together with the pot bottom of the housing pot, encloses an encapsulated coil space in which the solenoid coil is situated and, together with the housing cap, encloses a fluid-filled valve space into which the nozzle body protrudes. A valve needle is guided axially displaceably in the nozzle body and carries a closing head cooperating with the valve seat on one end. There is an annular clearance between the valve needle and the cylinder wall of the nozzle body, through which the fluid flows from the valve space to the metering opening. A magnet armature of the electromagnet attached to the valve needle delimits the working air gap of the electromagnet with the end face of the nozzle body protruding out of the coil space. A valve-closing spring, designed as a disk spring, is supported between the magnet armature and the support ring, exerting on the magnet armature a force, which applies the closing head to the valve seat via the valve needle. A folded or corrugated bellows arrangement, having a folded or corrugated bellows connected tightly to the valve needle and the cap bottom and a calibration spring situated in the folded or corrugated bellows, extends between the end of the valve needle remote from the closing head and the cap bottom of the housing cap in the valve space. The calibration spring is supported on the needle end of the valve needle on the one hand and on an axially adjustable adjusting bolt in the cap bottom on the other hand. The calibration spring may be prestressed in the desired way by displacement of the adjusting bolt and acts upon the valve needle with a compressive force acting in the valve opening direction. The diameter of the valve seat and the hydraulic diameter of the folded or corrugated bellows are the same, so that the valve needle is pressure equalized for all fluid pressures, and the dynamic response of the valve is independent of the fluid pressure.

BRIEF SUMMARY OF THE INVENTION

The valve according to the present invention has the advantage that the gimbal-mounted spring, unlike a helical compression spring or a disk spring, which is generally used as the valve-closing spring, for example, does not exert any transverse force on the thin, elongated valve needle, thereby reliably preventing any deflection of the valve needle. Therefore, the valve needle may be passed through components of the electrical actuator with only a small radial clearance, so that both the outside diameter of the valve and the length of the valve may be kept small in combination with the low total height of the spring disk. The valve needle has additional radial support from the gimbal-mounted spring disk, so that the number of sliding guides of the valve needle in the valve housing may be reduced. Tolerance-related skewed positions of the supports of the spring disk relative to the central axis of the valve needle are compensated by the gimbal mount. The overall manufacturing costs of the valve are reduced.

According to one advantageous specific embodiment of the present invention, the spring disk is supported on the valve needle and on the valve housing and one of the two supports is designed as a gimbal mount. Due to the prestressing of the spring disk required to generate the valve-closing force, a frictional force occurs at the support, which is not formed by the gimbal mount, so that the valve needle has additional radial support, while radial oscillation of the valve needle is prevented. This may be further improved by the fact that the gimbal mount is formed on the radial shoulder present on the valve needle, and the spring disk is secured on its support on the radial shoulder, which is provided on the valve housing, in at least some points.

According to one advantageous specific embodiment of the present invention, the valve housing has a valve tube, a hollow valve body on the inlet end, which is connected to the valve tube at its one end in a fluid-tight manner, and in which the inlet opening is formed, and has a hollow valve body on the metering end, which is connected to the valve tube in a fluid-tight manner at its other end, the metering opening and the valve seat being formed in this valve body and the valve needle being guided axially displaceably. The radial shoulder present on the valve housing is secured by a ring surface, pointing toward the inlet end of the valve body, of a support ring, which rests on the valve tube near the inlet end of the valve body, or alternatively, is integrally molded in one piece on the metering end of the valve body, and the radial shoulder present on the valve needle is formed by an end face, pointing toward the metering end of the valve body, of a support sleeve, which is secured to and rests on the valve needle near the inlet end of the valve body, or alternatively, near the metering end of the valve body. These structural measures permit cost-efficient manufacture and simple assembly of the valve with implementation of the gimbal mounting of the spring disk taking place at the same time.

According to advantageous specific embodiments of the present invention, the outer annular jacket of the support ring secured on the valve tube is provided with axial grooves to maintain fluid flow from the inlet opening to the metering opening when the support sleeve is secured on the valve needle near the inlet end of the valve body, or alternatively, the ring surface of the support ring integrally molded on the metering end of the valve body and pointing toward the inlet end of the valve body is provided with radial grooves when the support sleeve is secured on the valve needle near the metering end of the valve body.

According to one advantageous specific embodiment of the present invention, the sleeve secured on the valve needle near the inlet end of the valve body is integrally molded in one piece on an adapter, connecting the end of the valve needle, remote from the closing head, to an elastic hollow body, which is situated coaxially with the valve needle in the hollow valve body on the inlet end at a radial distance from the wall of the body. At the same time, the adapter seals the hollow body in a fluid-tight manner on the end face, while a valve-closing element inserted with a fluid-tight seal into the valve body on the inlet end contains the inlet opening and seals the other end face of the hollow body in a fluid-tight manner. Such an elastic hollow body, which is under a vacuum or is filled with gas having a low thermal expansion, causes a hydraulic pressure equalization on the valve needle, thereby compensating for the fluid pressure acting on the closing head in the valve opening direction. The closing force of the spring disk may therefore be kept lower. With a lower valve-closing force, the compressive force of the electrical actuator required to open the valve is reduced, so that an electrical actuator of a lower power and thus a more compact design may be used. Integration of the hollow body into the valve body on the inlet end, which is additionally molded to form a connecting piece insertable into a connecting cup of a fluid supply line, avoids enlarging the axial total height of the valve due to the hollow body.

An electromagnet is advantageously used as the electrical actuator. However, the electrical actuator may also be a piezoelectric or magnetostrictive actuator of a known type, which has a central bore through which the valve needle passes. The fluid flow is preferably guided over a hollow valve needle section in the area of the piezoelectrical actuator to the metering opening.

When using an electromagnet, the magnet armature is fixedly connected to the valve needle, a hollow cylindrical magnetic core being secured in the interior of the valve tube, the valve needle passing through the magnetic core, a magnetic pot being secured on the outside of the valve tube and a solenoid coil being accommodated in the magnetic pot, resting with its coil body on the valve tube.

DETAILED DESCRIPTION OF THE INVENTION

Figure 1:
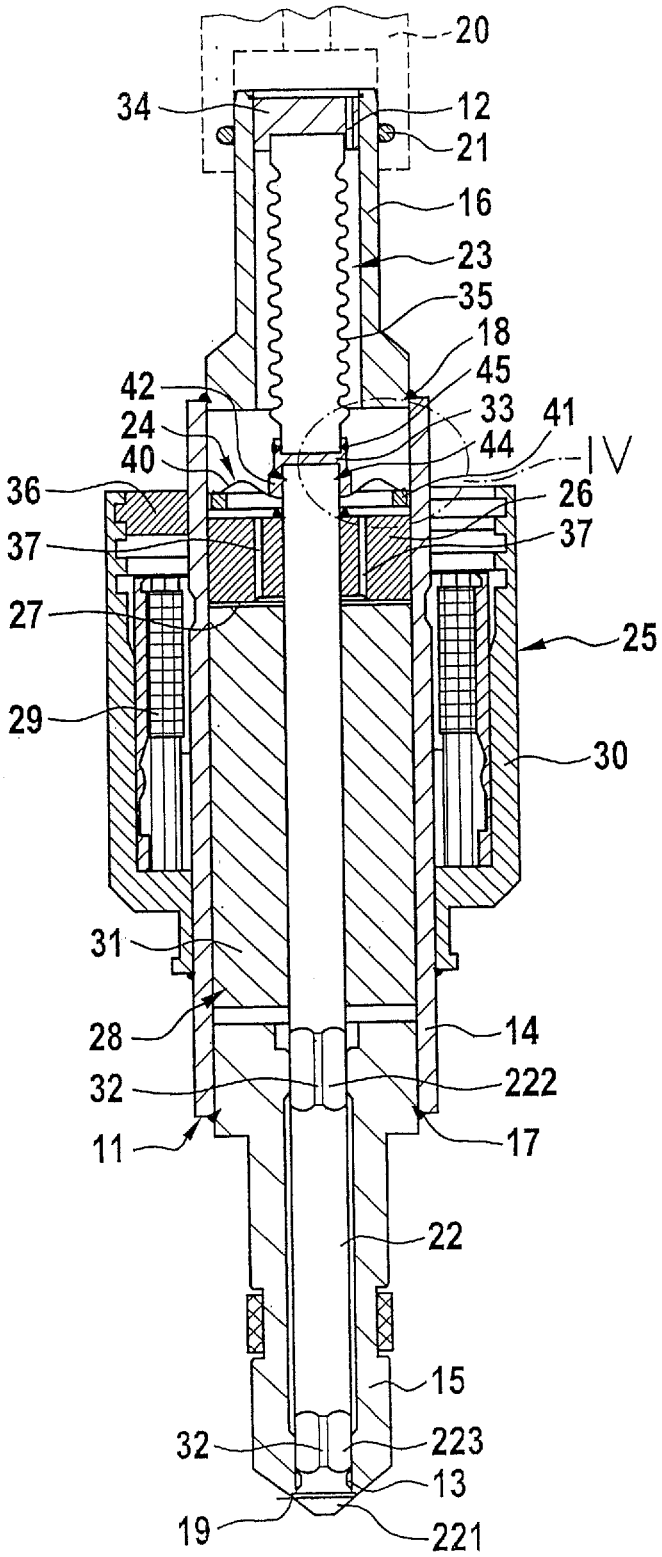
FIG. 1 shows a longitudinal section through a valve for metering fluid.

The valve shown in a sectional view in the drawing for metering of fluid under pressure is inserted into the combustion chamber of an internal combustion engine or into an intake channel leading to the combustion chamber of the internal combustion engine for injection of fuel. However, it may also be used as an injection valve for metering of gas volumes in gas engines.

The valve has a valve housing 11 having an inlet opening 12 for supplying fluid and a metering opening 13 for metered spraying of fluid. Valve housing 11 is assembled from a valve tube 14, a hollow valve body 15 on the metering end connected in a fluid-tight manner to valve tube 14 on its tube end and a hollow valve body 16 on the inlet end, also connected in a fluid-tight manner to valve tube 14 on its other end. The fluid-tight connection is established with the aid of an integral bond, for example, by peripheral welds 17, 18. Metering opening 13 and a valve seat 19 surrounding metering opening 13 and having a seat surface pointing outward in the spray direction are formed at the end in valve body 15 on the metering end. Valve body 16 on the inlet end has inlet opening 12. It is molded to form a connecting piece, which is inserted into a connecting cup 20, indicated with dashed lines, of a so-called rail, i.e., a feeder line for the fluid, and is sealed there with the aid of a sealing ring 21. The valve has a thin, elongated valve needle 22, which is provided with a closing head 221 and is pressure equalized by an elastic hollow body 23, which is exposed to the fluid pressure and is connected to valve needle 22 by an elastic hollow body on the end of valve needle 22 remote from the closing head. The term "pressure equalized" as used here means that the compressive force of the fluid acting on closing head 221 in the opening direction is compensated approximately by the tensile force created by hollow body 23 on valve needle 22 under the influence of the fluid pressure. Elastic hollow body 23 is aligned coaxially with valve needle 22 and is accommodated in valve body 16 on the inlet end. A valve-closing spring 24, which places closing head 221 on valve seat 19, engages on valve needle 22. An electrical actuator 25, which engages on the end of valve needle 22 remotely from the closing head, is used for lifting the closing head 221 of valve needle 22 from valve seat 19 against the closing force of valve-closing spring 24. The electrical actuator 25 is, for example, an electromagnet which has in a known way a magnet armature 26 including axial channels 37 for the fluid passage connected to valve needle 22, a magnet armature 26 enclosing a working air gap 27, a hollow cylindrical magnetic core 31 forming a so-called internal pole, a magnet coil 29 and a magnet pot 30 enclosing magnet coil 29. Magnet pot 30 is secured externally on valve tube 14 using a pot section of a smaller diameter and is coupled to valve tube 14 via a ferromagnetic return path yoke 36 located at its pot opening. Internal pole or magnetic core 31 is secured internally on valve tube 14 and surrounds a needle section of valve needle 22. Valve needle 22 is guided axially displaceably by two sliding sections 222, 223 in valve body 16 on the metering end. Sliding sections 222, 223 are provided with axial grooves 32 for the passage of fluid.

Elastic hollow body 23, which is aligned coaxially with valve needle 22 and is preferably designed as a metallic folded or corrugated bellows 35, is hermetically sealed at one end by an adapter 33 and at the other end by a closure element 34 and is filled with a gas having a low thermal expansion or a vacuum. Adapter 33 is secured on the end of valve needle 22 remotely from the closing head, and closure element 34 is inserted in a fluid-tight manner into valve body 16 on the inlet end. Inlet opening 12 in the form of an axial through-bore is introduced into closure element 34. The tight connection of adapter 33 and closure element 34 to metallic folded or corrugated bellows 35 is again accomplished with the aid of an integral bond. Likewise the connection of adapter 33 to valve needle 22 and closure element 34 to valve body 16 on the inlet end are established with the aid of an integral bond. Folded or corrugated bellows 35 has a hydraulic diameter D2, which is at least approximately equal to diameter D1 of valve seat 19. Hydraulic diameter D2 is understood here to be a diameter on which the fluid under pressure acts over the entire axial length of elastic hollow body 23 or folded or corrugated bellows 35. The pressure of the fluid on the folded or corrugated bellows 35 is converted by folded or corrugated bellows 35 into a tensile force acting on the end of valve needle 22 remote from the closing head, this tensile force being applied to closing head 221 against valve seat 19.

Figure 2:
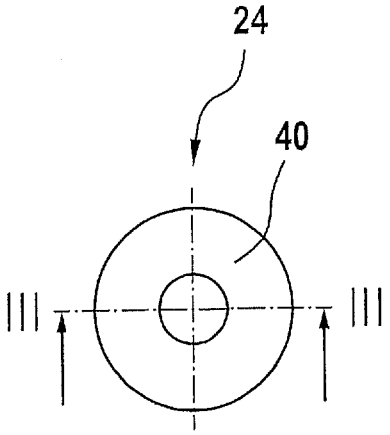
FIG. 2 shows a top view of a valve-closing spring in the valve according to FIG. 1.
Figure 3:
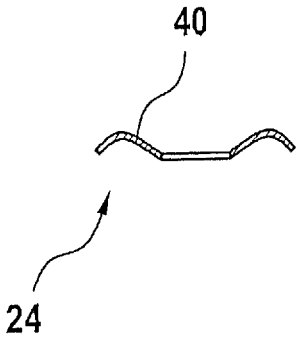
FIG. 3 shows a section along line III-III in FIG. 2.

Valve-closing spring 24 is designed as a gimbal-mounted spring disk 40 pushed onto the valve needle, which is supported on valve needle 22 and on valve housing 11, one of the two supports being designed as a gimbal mount. Spring disk 40 is shown in a top view in FIG. 2 and in a sectional view in FIG. 3. The support of spring disk 40 on the valve needle end rests on a radial shoulder present on valve needle 22 and the support of spring disk 40 on the valve housing end rests on a radial shoulder present on valve housing 11. The gimbal mount is formed by a spherical zone having sphere radius r, which is integrally molded on the shoulder surface of the radial shoulder on valve needle 22 pointing toward the metering end of valve body 15 having metering opening 13, or is alternatively molded in the shoulder surface of the radial shoulder on valve housing 11, this shoulder surface pointing toward valve body 16 on the inlet end having inlet opening 12.

Figure 4:
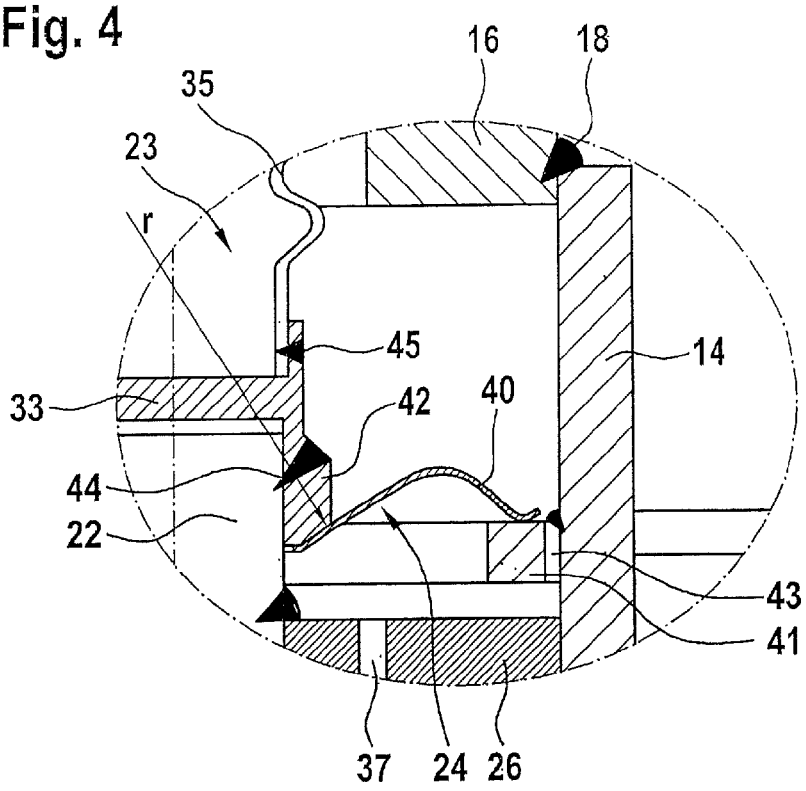
FIG. 4 shows an enlarged diagram of detail IV in FIG. 1.
Figure 5:
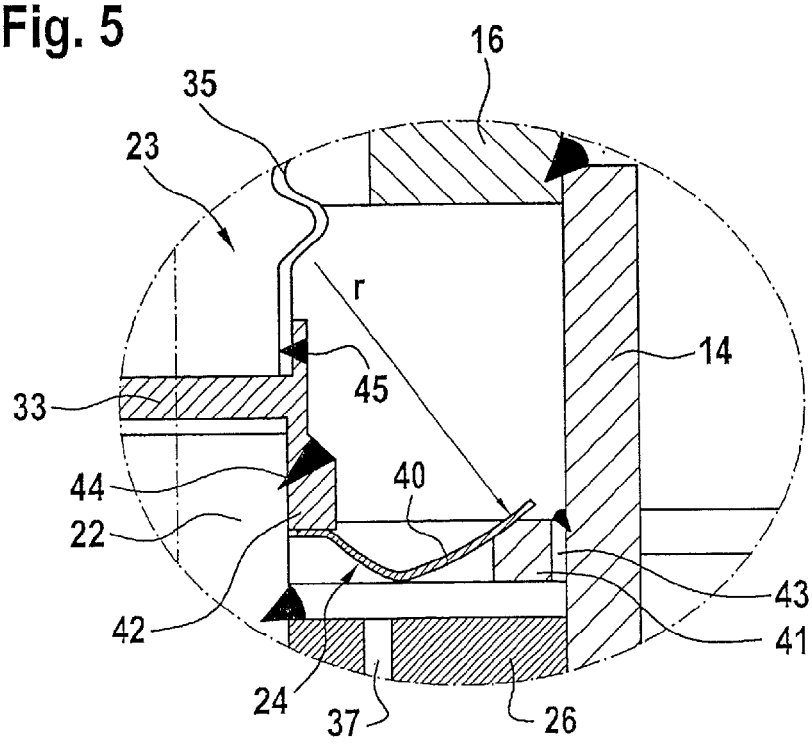
FIG. 5 shows the same diagram as in FIG. 4 with one modification in the area of the valve-closing spring.

In the exemplary embodiment of the valve according to FIGS. 1 through 5, the radial shoulder present on valve housing 11 is formed by a ring surface of a support ring 41 pointing toward the inlet end of valve body 16 having inlet opening 12, and the support shoulder present on valve needle 22 is formed by an end face of a support sleeve 42 pointing toward the metering end of valve body 15 having metering opening 13, this end face being situated near the inlet end of valve body 16 on valve needle 22. Support sleeve 42 is integrally molded in one piece on the adapter 33 connecting the folded or corrugated bellows 35 to valve needle 22 (FIGS. 4 and 5). Support ring 41 is secured on valve tube 14 by welding near the inlet end of valve body 16 above magnet armature 26, for example, and has axial grooves 43 for the passage of fluid in its annular jacket on the outside of valve tube 14.

In the exemplary embodiment of the valve according to FIGS. 1 through 4, the gimbal mount is formed on support sleeve 42 by integral molding of a spherical zone having sphere radius r on the lower end face of support sleeve 42 pointing toward the metering end of valve body 15. Spring disk 40 rests with its spring edge under prestress on the ring surface of support ring 41 pointing toward the inlet end of valve body 16. Due to the prestress, a frictional force occurs between spring disk 40 and support ring 41. Valve needle 22 is additionally supported radially by this frictional force and prevents radial oscillation of valve needle 22. This may be further improved by the fact that—as will not be discussed further here—spring disk 40 is secured in at least some spots in its support on support ring 41, which may be achieved by spot welds, for example. In this structural embodiment, sliding guide 222 on valve needle 22 may be omitted. The prestress of spring disk 40 is adjusted by appropriate displacement of valve needle 22 in adapter 33 before adapter 33 having integrally molded support sleeve 42 is connected to valve needle 22 by integral bonding. In FIG. 4, the integral bond between valve needle 22 and adapter 33 is made visible by weld 44, and the integral bond of adapter 33 to folded or corrugated bellows 35 is made visible by peripheral weld 45.

The modification shown in FIG. 5 in the arrangement of valve-closing spring 24 differs from the arrangement shown in FIG. 4 in that the gimbal mount and the support of spring disk 40 on support ring 41 and support sleeve 42 are switched, i.e., the gimbal mount is on support ring 41 and the support of spring disk 40 is on support sleeve 42. The spherical zone having sphere radius r is integrally molded into the ring surface of support ring 41 pointing toward the inlet end of valve body 16 in which spring disk 40 rests at its outer edge area, while the inner edge area of spring disk 40 rests on the end face of support sleeve 42 pointing toward valve body 15 on the metering end.

Figure 6:
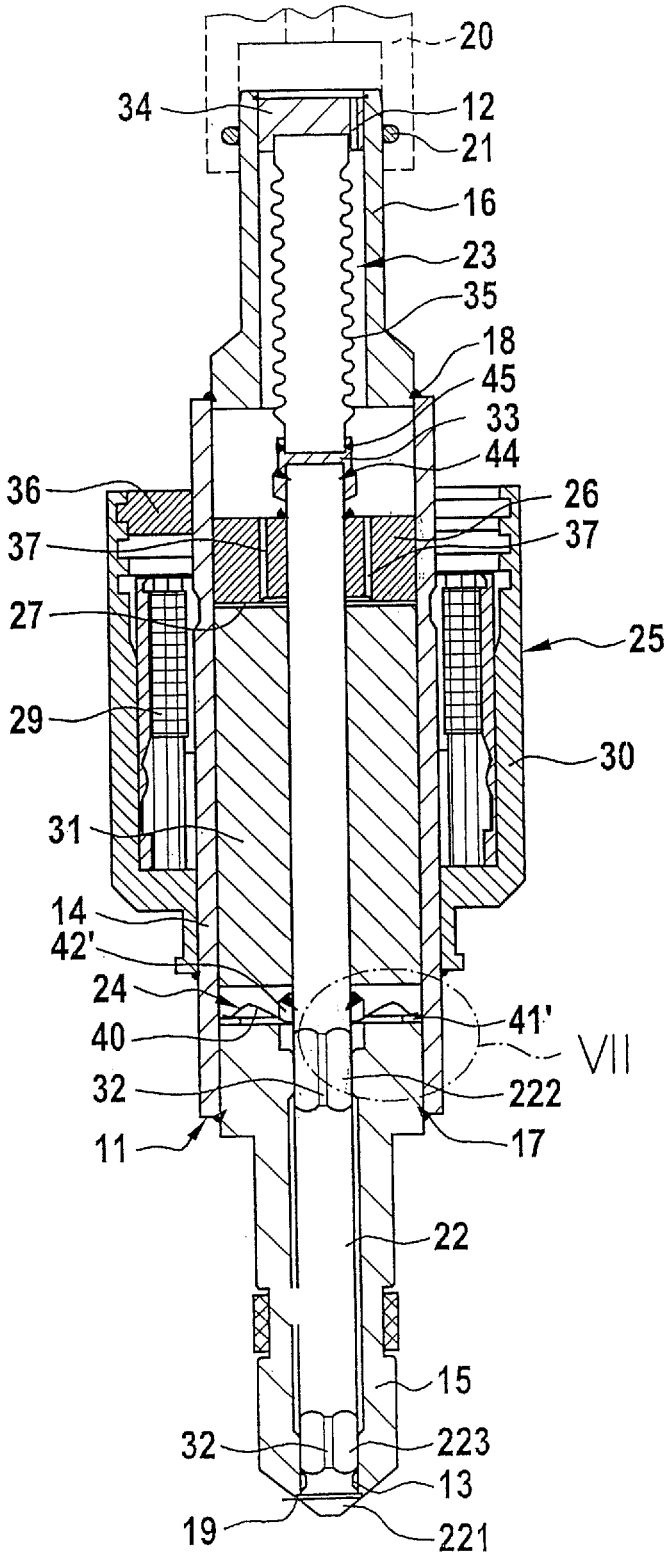
FIG. 6 shows a longitudinal section through the valve according to another exemplary embodiment.
Figure 7:
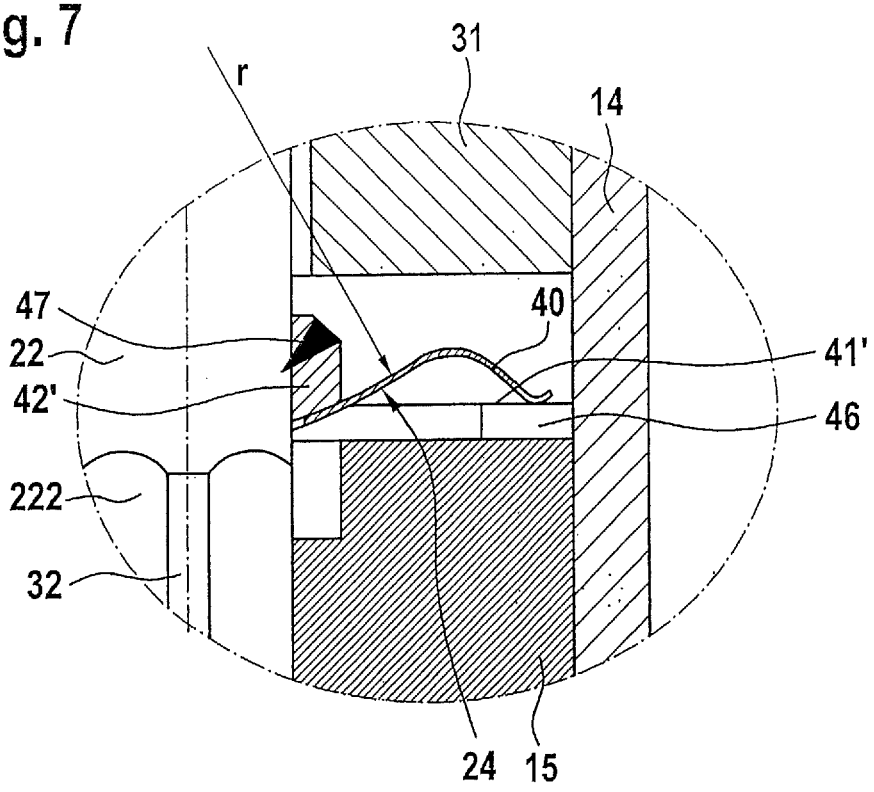
FIG. 7 shows an enlarged diagram of detail VII in FIG. 6.
Figure 8:
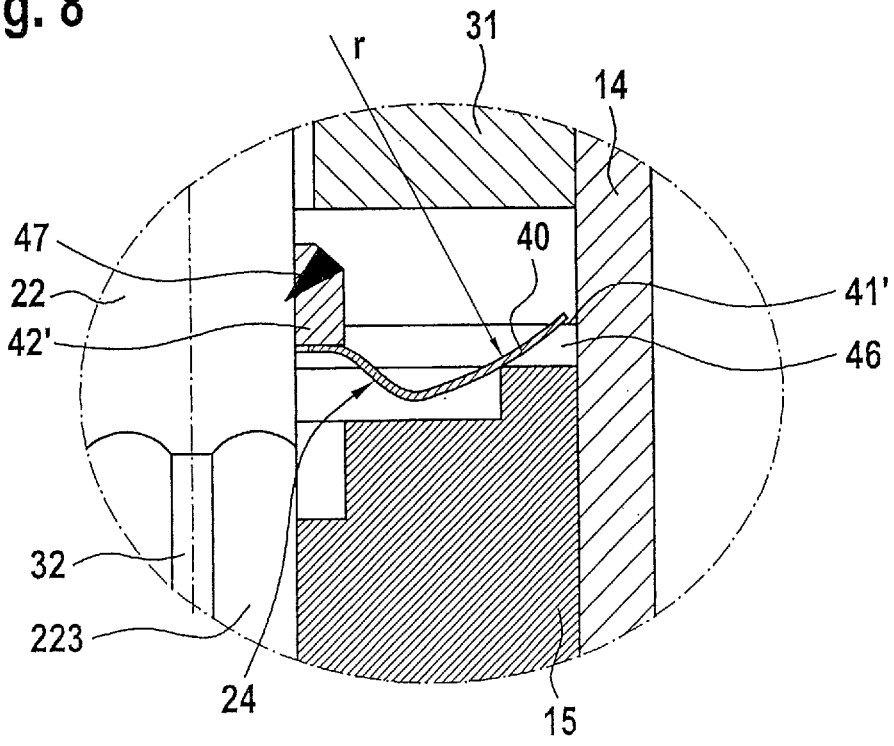
FIG. 8 shows the same diagram as that in FIG. 7 with one modification in the area of the valve-closing spring.

The exemplary embodiment of the valve shown in FIGS. 6 through 8 differs from the exemplary embodiment described previously only in the displacement of the arrangement of valve-closing spring 24 away from valve body 16 on the inlet end above magnet armature 26 toward the metering end of valve body 15 beneath magnetic core 31. FIG. 6 otherwise corresponds to FIG. 1, so that the same parts are labeled with the same reference numerals. The radial shoulder present on valve housing 11 is again formed by the ring surface of a support ring 41' pointing toward the inlet end of valve body 16 having inlet opening 12, and the radial shoulder present on valve needle 22 being formed by the end face of a support sleeve 42' pointing toward the metering end of valve body 15 having metering opening 13. In contrast with FIGS. 1 through 5, support ring 41' is formed in one piece on metering end of valve body 15 and has radial grooves 46 for the passage of fluid in its end face, while support sleeve 42' is secured integrally bonded on valve needle 22 near the metering end of valve body 15. The integral bond is implemented with the aid of a peripheral weld 47.

In the exemplary embodiment in FIGS. 6 and 7, the gimbal mount is provided on support sleeve 42', and the support of spring disk 40 is provided on support ring 41'. To form the gimbal mount, the spherical zone having sphere radius r is integrally molded on the lower end face of support sleeve 42' pointing toward the metering end of valve body 15. The prestress of spring disk 40, with which it rests on support ring 41', is adjusted by corresponding positioning of support sleeve 42' relative to support ring 41' before support sleeve 42' is welded to valve needle 22.

The modification shown in FIG. 8 in the arrangement of spring disk 40 differs from that shown in FIG. 7 by switching the gimbal mount and the support for spring disk 40.

The gimbal mount is formed on support ring 41' and the support of spring disk 40 is provided on support sleeve 42'. For this purpose, the spherical zone having sphere radius r is molded into the ring surface of support ring 41' pointing toward the inlet end of valve body 16, spring disk 40 with its outer edge being enclosed in the spherical zone in a form-fitting manner, while the inner spring edge area of spring disk 40 rests on the end face of support sleeve 42' pointing toward the metering end of valve body 15 under prestress. This prestress is adjusted by the same method as that described previously.

What is claimed is:

1. A valve for metering fluid under pressure, comprising:

a valve housing having an inlet opening for supplying fluid and a metering opening for spraying the fluid;

a valve seat formed on the valve housing and surrounding the metering opening, the valve seat including a seat surface pointing in a spray direction;

a valve needle carrying a closing head;

a valve-closing spring which engages on the valve needle and applies the closing head to the valve seat while closing the metering opening; and an electrical actuator applying an outwardly lifting compressive force to the valve needle, lifting the closing head away from the valve seat to release the metering opening;

wherein the valve-closing spring is a spring disk pushed onto the valve needle and includes an arcuate contact surface that contacts a radial shoulder support surface, the spring disk being gimbal mounted due to the contact of the arcuate contact surface with the radial shoulder support surface.

2. The valve as recited in claim 1, wherein the spring disk is supported on the valve needle and on the valve housing using two supports, and the radial shoulder support surface is a surface of one of the two supports.

3. The valve as recited in claim 2, wherein the support for the supporting of the spring disk on the valve needle is a radial shoulder present on the valve needle, and the support for the supporting of the spring disk on the valve housing is a radial shoulder present on the valve housing, the radial shoulder support surface being a surface of at least one of the radial shoulders.

4. The valve as recited in claim 3, wherein the gimbal mounting is formed by a spherical zone which is integrally molded on the radial shoulder support surface.

5. The valve as recited in claim 3, wherein the gimbal mounting is formed on the radial shoulder present on the valve needle, and the spring disk is also secured on the radial shoulder present on the valve housing.

6. The valve as recited in claim 3, wherein:

the valve housing has:

a valve tube;

a first hollow valve body in which the inlet opening is formed and that is connected in a fluid-tight manner to an inlet end of the valve tube; and a second hollow valve body in which the metering opening and the valve seat are formed and that is connected in a fluid-tight manner to a metering end of the valve tube;

the valve needle is guided axially displaceably in the valve housing;

the radial shoulder present on the valve housing is secured by a ring surface of a support ring pointing toward the inlet end of the valve body, the support ring being one of (i) secured on the valve tube near the valve body on the inlet end or (ii) integrally molded in one piece on the valve body on the metering end; and the radial shoulder present on the valve needle is formed by an end face of a support sleeve pointing toward the metering end of the valve body, the support sleeve being secured on the valve needle near the valve body on one of the inlet end or the metering end.

7. The valve as recited in claim 6, wherein an outer annular jacket of the support ring secured on the valve tube is provided with axial grooves.

8. The valve as recited in claim 6, wherein the support sleeve secured on the valve needle is integrally molded in one piece on an adapter, which connects the end of the valve needle, remote from the closing head, to an elastic hollow body, which is situated coaxially with the valve needle in the valve body on the inlet end at a radial distance from the wall of the body.

9. A valve for metering fluid under pressure, comprising:

a valve housing having an inlet opening for supplying fluid and a metering opening for spraying the fluid;

a valve seat formed on the valve housing and surrounding the metering opening, the valve seat including a seat surface pointing in a spray direction;

a valve needle carrying a closing head;

a valve-closing spring which engages on the valve needle and applies the closing head to the valve seat while closing the metering opening; and an electrical actuator applying an outwardly lifting compressive force to the valve needle, lifting the closing head away from the valve seat to release the metering opening;

wherein:

the valve-closing spring is a gimbal-mounted spring disk that is pushed onto the valve needle and that is supported on the valve needle and on the valve housing using two supports, one of which is a gimbal mount;

the support for the supporting of the spring disk on the valve needle is a radial shoulder present on the valve needle, and the support for the supporting of the spring disk on the valve housing is a radial shoulder present on the valve housing;

the valve housing has:

a valve tube;

a first hollow valve body in which the inlet opening is formed and that is connected in a fluid-tight manner to an inlet end of the valve tube; and a second hollow valve body in which the metering opening and the valve seat are formed and that is connected in a fluid-tight manner to a metering end of the valve tube;

the valve needle is guided axially displaceably in the valve housing;

the radial shoulder present on the valve housing is secured by a ring surface of a support ring pointing toward the inlet end of the valve body, the support ring being one of (i) secured on the valve tube near the valve body on the inlet end or (ii) integrally molded in one piece on the valve body on the metering end;

the radial shoulder present on the valve needle is formed by an end face of a support sleeve pointing toward the metering end of the valve body, the support sleeve being secured on the valve needle near the valve body on one of the inlet end or the metering end; and the ring surface of the support ring pointing toward the valve body on the inlet end is provided with radial grooves, the support ring being integrally molded on the valve body on the metering end.

10. A valve for metering fluid under pressure, comprising:

a valve housing having an inlet opening for supplying fluid and a metering opening for spraying the fluid;

a valve seat formed on the valve housing and surrounding the metering opening, the valve seat including a seat surface pointing in a spray direction;

a valve needle carrying a closing head;

a valve-closing spring which engages on the valve needle and applies the closing head to the valve seat while closing the metering opening; and an electrical actuator applying an outwardly lifting compressive force to the valve needle, lifting the closing head away from the valve seat to release the metering opening;

wherein:

the valve-closing spring is a gimbal-mounted spring disk that is pushed onto the valve needle and that is supported on the valve needle and on the valve housing using two supports, one of which is a gimbal mount;

the support for the supporting of the spring disk on the valve needle is a radial shoulder present on the valve needle, and the support for the supporting of the spring disk on the valve housing is a radial shoulder present on the valve housing;

the valve housing has:

a valve tube;

a first hollow valve body in which the inlet opening is formed and that is connected in a fluid-tight manner to an inlet end of the valve tube; and a second hollow valve body in which the metering opening and the valve seat are formed and that is connected in a fluid-tight manner to a metering end of the valve tube;

the valve needle is guided axially displaceably in the valve housing;

the radial shoulder present on the valve housing is secured by a ring surface of a support ring pointing toward the inlet end of the valve body, the support ring being one of (i) secured on the valve tube near the valve body on the inlet end or (ii) integrally molded in one piece on the valve body on the metering end;

the radial shoulder present on the valve needle is formed by an end face of a support sleeve pointing toward the metering end of the valve body;

the support sleeve is secured on the valve needle near the valve body on one of the inlet end or the metering end and is integrally molded in one piece on an adapter, which connects the end of the valve needle, remote from the closing head, to an elastic hollow body;

the elastic hollow body is situated coaxially with the valve needle in the valve body on the inlet end at a radial distance from the wall of the body and is sealed by the adapter on the end face and a closing element which is inserted in a fluid-tight manner into the first hollow valve body on the inlet end; and the closing element includes the inlet opening.

11. The valve as recited in claim 10, wherein one of a gas filling or a vacuum is present in the hollow body.

12. The valve as recited in claim 10, wherein the elastic hollow body is formed by one of a folded or corrugated bellows made of metal.

13. A valve for metering fluid under pressure, comprising:

a valve housing having an inlet opening for supplying fluid and a metering opening for spraying the fluid;

a valve seat formed on the valve housing and surrounding the metering opening, the valve seat including a seat surface pointing in a spray direction;

a valve needle carrying a closing head;

a valve-closing spring which engages on the valve needle and applies the closing head to the valve seat while closing the metering opening; and an electrical actuator applying an outwardly lifting compressive force to the valve needle, lifting the closing head away from the valve seat to release the metering opening;

wherein:

the valve-closing spring is a gimbal-mounted spring disk that is pushed onto the valve needle and that is supported on the valve needle and on the valve housing using two supports, one of which is a gimbal mount;

the support for the supporting of the spring disk on the valve needle is a radial shoulder present on the valve needle, and the support for the supporting of the spring disk on the valve housing is a radial shoulder present on the valve housing;

the valve housing has:

a valve tube;

a first hollow valve body in which the inlet opening is formed and that is connected in a fluid-tight manner to an inlet end of the valve tube; and a second hollow valve body in which the metering opening and the valve seat are formed and that is connected in a fluid-tight manner to a metering end of the valve tube;

the valve needle is guided axially displaceably in the valve housing;

the radial shoulder present on the valve housing is secured by a ring surface of a support ring pointing toward the inlet end of the valve body, the support ring being one of (i) secured on the valve tube near the valve body on the inlet end or (ii) integrally molded in one piece on the valve body on the metering end;

the radial shoulder present on the valve needle is formed by an end face of a support sleeve pointing toward the metering end of the valve body, the support sleeve being secured on the valve needle near the valve body on one of the inlet end or the metering end;

the electrical actuator is formed as an electromagnet having:

a magnet armature fixedly connected to the valve needle;

a hollow cylindrical magnetic core which is secured in the valve tube;

a solenoid coil; and a magnetic pot accommodating the solenoid coil, the magnetic pot being secured on the outside of the valve tube;

the valve needle passes centrally through the magnetic core; and the magnetic core and the magnet armature together delimit a working air gap.

14. The valve as recited in claim 6, wherein a sliding piece is situated on the valve needle near the closing head, and wherein the sliding piece is guided slidingly in the valve body on the metering end and has at least one axial groove for the fluid passage.

15. The valve as recited in claim 4, wherein the radial shoulder support surface is a surface of the radial shoulder present on the valve needle and faces toward the metering opening.

16. The valve as recited in claim 4, wherein the radial shoulder support surface is a surface of the radial shoulder present on the valve housing and faces toward the inlet opening.

* * * * *